US005203111A

United States Patent [19]

Huber et al.

[11] Patent Number: 5,203,111

[45] Date of Patent: Apr. 20, 1993

[54] REVOLVING DOOR FOR THE PROTECTION OF THE ACCESS TO AND/OR EXIT FROM A ROOM

[75] Inventors: Jacob R. A. Huber, Edam; Erik J. Huber, Purmer, both of Netherlands

[73] Assignee: Boon Edam B.V., Edam, Netherlands

[21] Appl. No.: 853,223

[22] Filed: Mar. 13, 1992

[30] Foreign Application Priority Data

Mar. 26, 1991 [NL] Netherlands ..... 9100527

[51] Int. Cl.[5] ..... E05D 15/02

[52] U.S. Cl. ..... 49/42

[58] Field of Search ..... 49/42, 43; 109/8

[56] References Cited

U.S. PATENT DOCUMENTS 4,627,193 12/1986 Schwarz ..... 49/42

5,076,013 12/1991 Gallenschutz et al. ..... 49/42

FOREIGN PATENT DOCUMENTS 8502858 5/1987 Netherlands .

2163322 2/1986 United Kingdom .

*Primary Examiner*—Philip C. Kannan

*Attorney, Agent, or Firm*—Pennie & Edmonds

[57] ABSTRACT

A revolving door for the protection of the access to and/or exit from a room is provided with a revolving shaft having a number of door wings spaced evenly around it, a pair of panels at opposite ends bordering on the path followed by the door wings and forming a partly closed zone with a first and a second opening, a drive motor for the shaft and a control unit for the drive motor. Further a monitor unit is provided having a detection aerial, which aerial generates a detection field, such that when a person carrying an authorization card enters the detection field the monitor unit sends an enable signal to the control unit to turn the shaft through a predetermined angle in the direction of passage to allow the person to proceed from the one opening to the other. Each door wing comprises a detection aerial, means being provided to switch each aerial on and off in turn, such that when the revolving door is stationary only the detection aerial of that door wing is activated which, seen in the direction of passage, is in front of the person who wishes to enter or leave the protected room.

5 Claims, 3 Drawing Sheets

REVOLVING DOOR FOR THE PROTECTION OF THE ACCESS TO AND/OR EXIT FROM A ROOM

BACKGROUND OF THE INVENTION

The invention relates to a revolving door for the protection of the access to and/or exit from a room, comprising a revolving shaft with a number of door wings spaced evenly around it, a pair of panels at opposite ends bordering on the path followed by the door wings and forming a partly closed zone with a first and a second opening, a drive motor for the shaft and a control unit for the drive motor, including a monitor unit with detection aerial, which aerial generates a detection field, such that when a person carrying an authorization card enters the detection field the monitor unit sends an enable signal to the control unit to turn the shaft through a predetermined angle in the direction of passage to allow the person concerned to proceed from the one opening to the other.

Such revolving doors are known in a number of different types and have the advantage that the person who wishes to pass the revolving door does not have to show his authorization card to a doorkeeper or insert it into a special card reader but, when approaching or entering the partly closed zone of the revolving door, the authorization card is detected by the detection field and the revolving door is activated automatically. A known revolving door of this kind has its detection aerial mounted to a windowpane in the one panel of the revolving door and a comparatively strong detection field has to be generated to make sure that the authorization card of the person entering the partly closed zone is detected. The known revolving door therefore has the disadvantage that the monitor unit, having detected an authorized person entering the partly closed zone of the revolving door through the first opening, again detects this person leaving this zone through the second opening, so that the control unit continues to activate the drive motor, making it possible for an unauthorized person to pass the revolving door. Because the detection field of the known revolving door extends beyond the revolving door itself, it is also possible that the monitor unit detects the authorization card of a person who in fact does not wish to pass the revolving door at all.

The object of the invention is to provide a revolving door of the type disclosed in the preamble, in which this disadvantage is effectively eliminated.

SUMMARY OF THE INVENTION

In order to achieve this object the revolving door according to the invention is characterized in that each door wing comprises a detection aerial, means being provided for switching on and off each aerial in turn, such that when the revolving door is not rotating only the detection aerial of that particular door wing is activated, which, seen in the direction of passage, is in front of the person who wishes either to enter or leave the protected room.

In this manner a revolving door is obtained in which the detection aerial has only to generate a comparatively weak detection field, detecting only the person who has entered the partly closed zone for passing the revolving door, the above means during rotation of the revolving door, switching the various detection aerials on and off in order. In addition the detection field for detecting of the authorization card is favourably directed with respect to a person approaching the door wing.

According to a preferred embodiment said means comprises a collector ring body mounted to the revolving shaft, which body is provided with a first collector ring with alternate conductive and non-conductive sectors, for each door wing being provided a conductive sector, to which the one end of the corresponding detection aerial is connected, which collector ring body comprises a second uninterrupted conductive collector ring to which the other ends of all detection aerials are connected, each of the two collector rings being connected to the monitor unit by means of a corresponding stationary contact element. The result is a sturdy construction with a long life span.

Preferably each conductive sector of the first collector ring extends through an angle of about 180°/number of door wings, each sector being connected to the monitor unit by means of the contact element as soon as the corresponding door wing while the shaft is revolving approximately has reached the front edge of the one panel. This ensures that, with a first person already between two successive door wings, a second person entering the partly closed zone to pass the revolving door will be detected immediately by the activated detection field of the following door wing before this door wing has even reached the position corresponding with the position it occupies when the revolving door is stopped.

In a particularly preferred embodiment a switched-on aerial is switched off immediately as soon as a person carrying an authorization card has been detected In this manner the possibility of a person leaving the revolving door being detected as one entering the revolving door is eliminated completely.

A specially attractive and efficient construction is achieved by using the metal frame of each door wing as a detection aerial.

SHORT DESCRIPTION OF THE DRAWINGS

The invention is further described below with reference to the accompanying drawings showing schematically by way of example one embodiment of the revolving door according to the present invention.

DETAILED DESCRIPTION OF A PREFERRED EMBODIMENT

Figure 1:
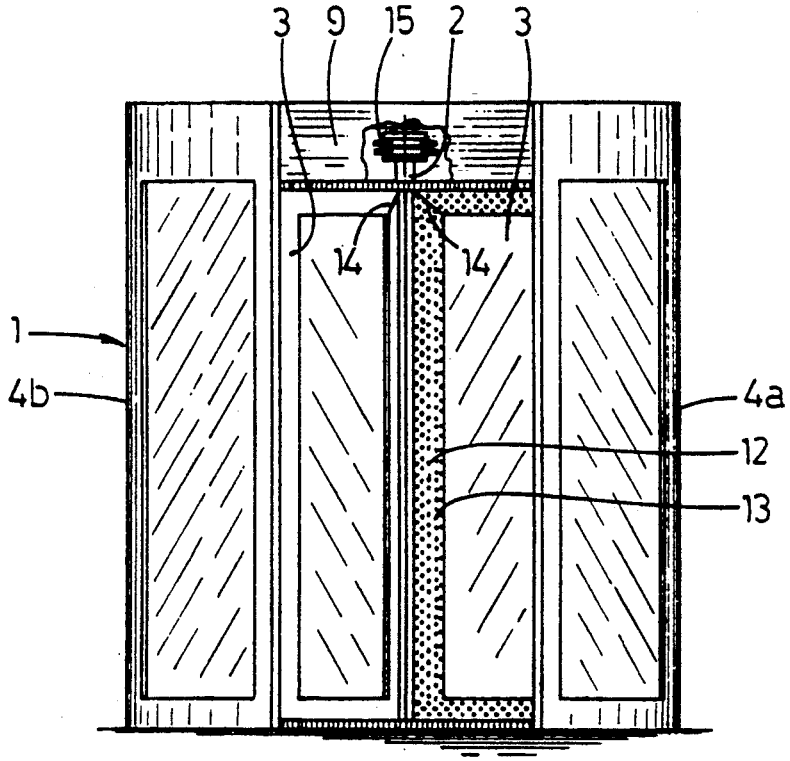
FIG. 1 is a front view of one embodiment of the revolving door according to the invention.
Figure 2:
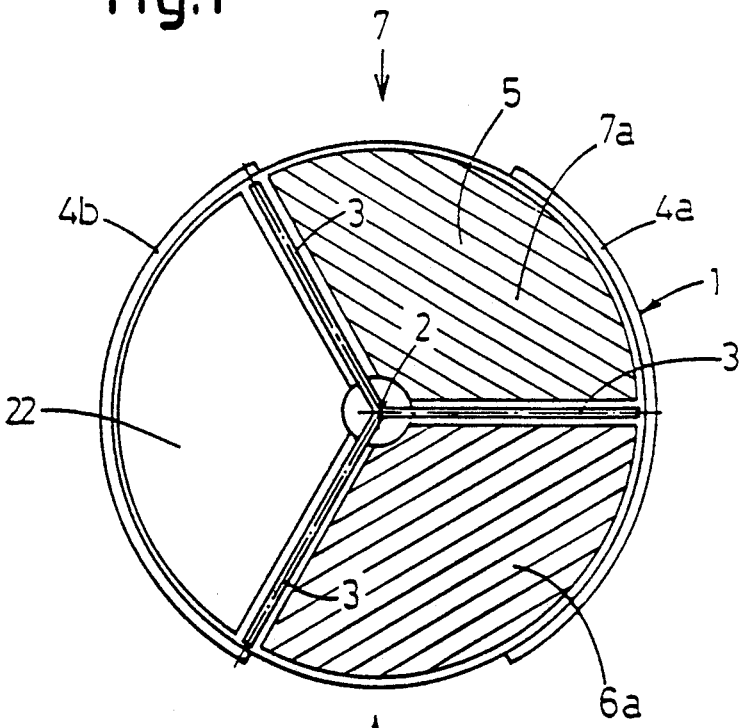
FIG. 2 is a horizontal cross-section of the revolving door in FIG. 1.
Figure 5:
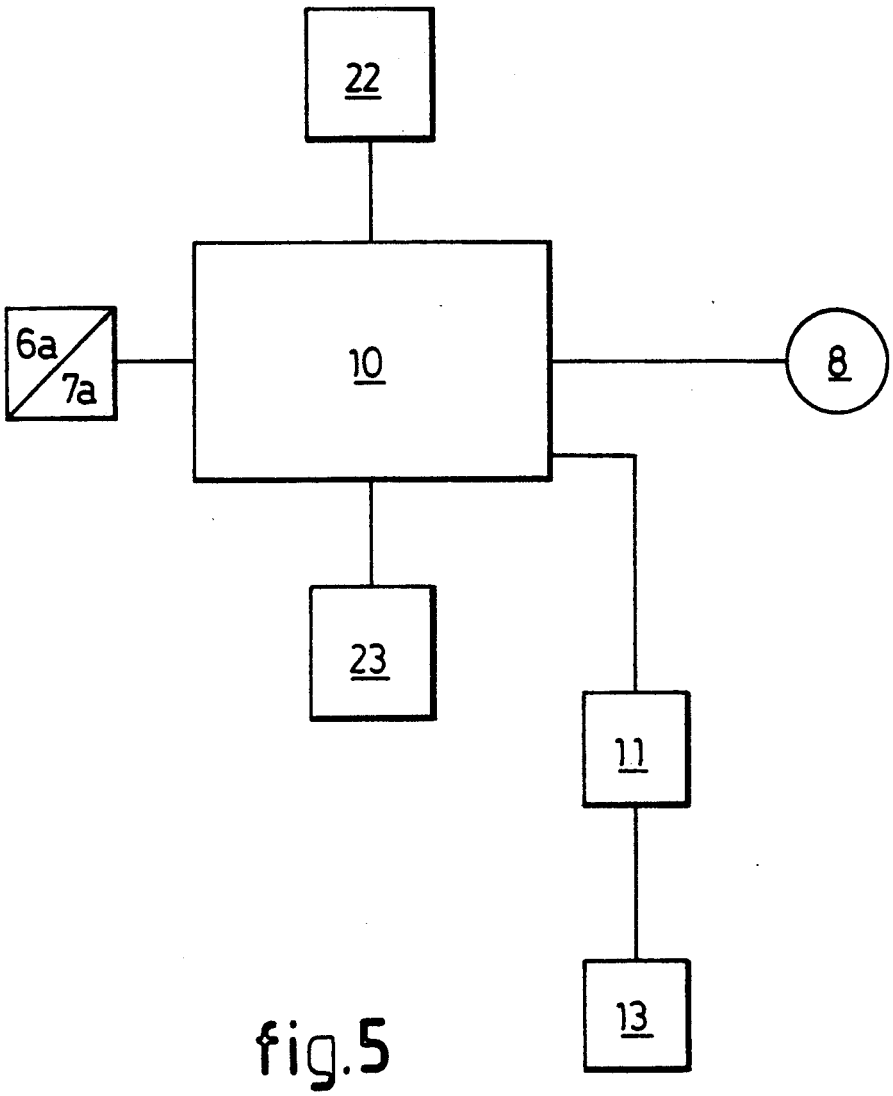
FIG. 5 is a strongly simplified block diagram covering the electrical system of the revolving door in FIG. 1.

FIG. 1 and FIG. 2 show the front view and a horizontal cross-section of a revolving door 1 respectively, which revolving door is provided with a revolving shaft 2 with three door wings 3 evenly spaced around it. The revolving door 1 is further provided with two panels 4*a* and 4*b* at opposite ends bordering on the path followed by the door wings 3 and together forming a partly closed zone 5 with a first opening 6 and a second opening 7. The shaft 2 is driven by a drive motor 8 schematically indicated in the block diagram FIG. 5, however not visible in FIG. 1, mounted in the space created by a cover 9 at the top of the revolving door 1.

The drive motor 8 is operated by a control unit 10 in order to turn the shaft 2 through an angle of 120° in the direction of passage from the opening 6 to the opening 7 or inversely. The position of the door wings 3 is determined with the aid of means 23 (see FIG. 5), known in themselves, however not further specified here, which could consist of terminal switches.

When a person wishing to pass the revolving door 1 carries a card authorizing access to and/or exit from the protected room a monitor unit 11 sends an enable signal to the control unit 10 operating the drive motor 8. Therefore, the metal frame 12 of each wing 3 of the revolving door referred to is formed as a detection aerial 13 (see FIG. 5), achieved by providing an insulating connection 14 in one corner of the frame 12. The two ends of the loop thus formed are connected to the monitor unit 11 by means yet to be specified. These means are such that while shaft 2 is rotating each detection aerial is switched on and off respectively, such that when the revolving door 1 is stationary only the detection aerial 13 of that door wing 3 is in operation, which, seen in the direction of passage, is in front of a person wishing either to enter or leave the protected room, i.e. wishing to enter the partly closed zone 5 through the opening 6 or 7 respectively. In the shown embodiment this is the door wing 3 directed to panel 4*a*.

Entry into the partly closed zone 5 through opening 6 or 7 is detected by means of a corresponding contact mat 6*a* and 7*a* respectively or another suitable presence sensor. In the shown embodiment the control unit 10 activates drive motor 8 to drive the shaft 2 in the appropriate direction as soon as a signal from the contact mat 6*a* or 7*a* and the enable signal from the monitor unit 11 are received.

Figure 3:
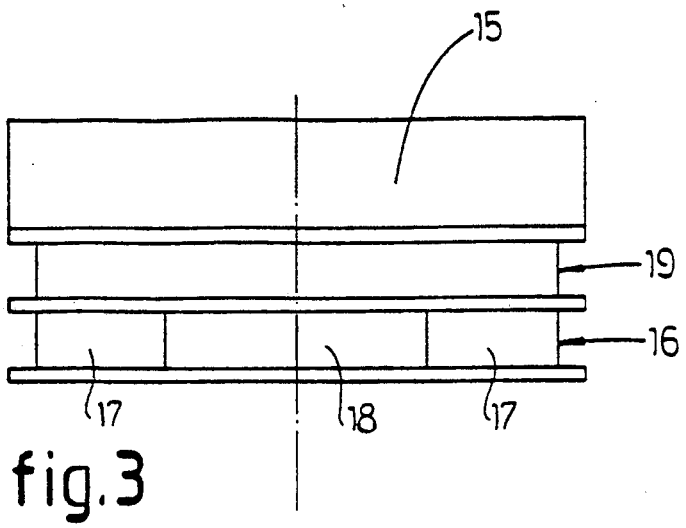
FIG. 3 shows the collector ring body of the revolving door in FIG. 1 in an enlarged scale.
Figure 4:
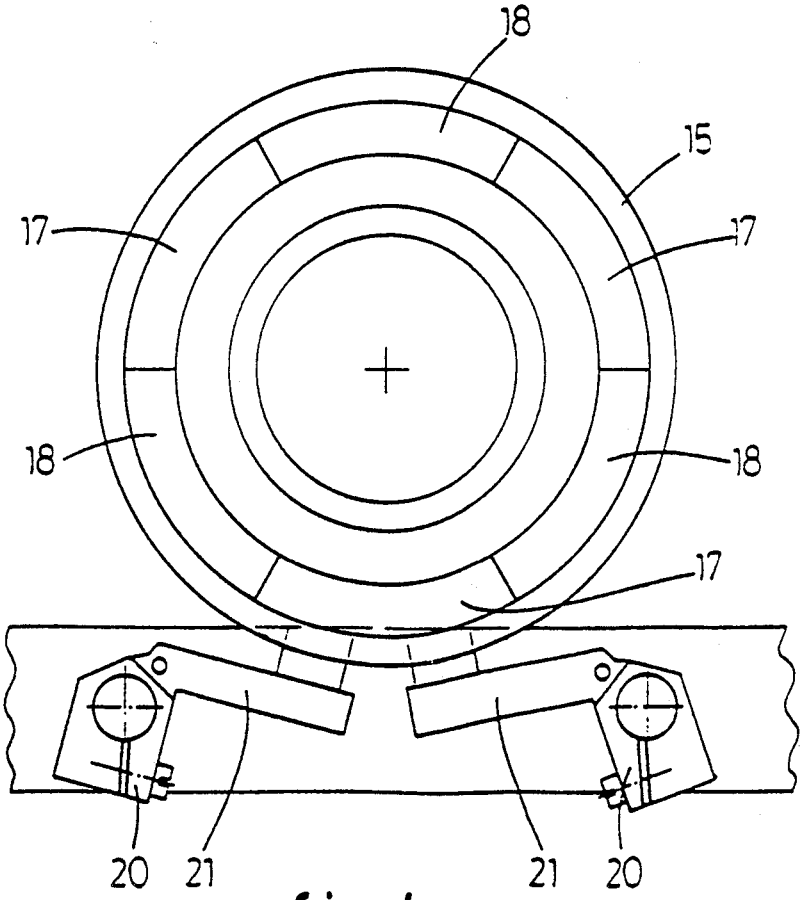
FIG. 4 is a bottom view of the collector ring body in FIG. 3 with its corresponding contact element.

In the illustrated embodiment said means comprises a collector ring body 15 mounted on the rotatable shaft 2, a more detailed illustration of which is shown in FIG. 3 and FIG. 4. This collector ring body 15 is provided with a first collector ring 16 with alternate conductive sectors 17 and non-conductive sectors 18. Each conductive sector 17 of the collector ring 16 is connected to a corresponding end of the frame 12 of a door wing 3. The other ends of the frames 12 of the door wings 3 are connected to a second collector ring 19, which is completely conductive. Collector rings 16, 19 are connected to the monitor unit 11 by means of a contact element 20, only one of which is visible in FIG. 4 and that is formed as two interconnected carbon brushes 21 to ensure a reliable connection between the collector rings 16, 19 and the monitor unit 11.

The sectors 17, 18 of the collector ring 16 each extend through an angle of about 60°, with the conductive sectors 17 and the corresponding contact elements 20 being positioned with respect to each other such that when the shaft 2 is rotating each conductive sector 17 is connected through the contact element 20 to the monitor unit 11 each time the corresponding door wing 3 approximately reaches the front edge of the one panel 4*a*. When the control unit 10 has thus activated the drive motor 8 to allow the passage of a person, the detection aerial 13 of the following door wing 3 is activated as soon as this door wing 3 has approximately reached the position of the front edge of the panel 4*a*, so that a following person carrying an authorization card can be detected immediately and the drive motor 8 is maintained activated by the control unit 10 until this following person has passed the revolving door 1.

In the revolving door described the monitor unit 11 switches off the detection aerial 13 in operation as soon as a person carrying an authorization card has been detected. This prevents a person leaving the revolving door from erroneously being detected as a person entering the revolving door.

As indicated by reference number 22 in FIG. 2 there is a contact mat between the two successive door wings 3 on the side of the panel 4*b*, which contact mat detects any person entering this area of zone 5 trying to proceed the opening 7 to the opening 6 coincidentally with an authorized person passing from the opening 6 to the opening 7. As soon as the contact mat 22 is being stepped upon, the control unit will stop the drive motor 8, so this unauthorized person can leave again the partly closed zone 5.

Although the invention is illustrated above based on a revolving door having three door wings 3, it will be appreciated that the revolving door could also have been provided with, for instance, four such wings.

The invention is not restricted to the embodiment illustrated above, which can be varied in several ways without exceeding the scope of the invention.

We claim:

1. Revolving door for the protection of the access to and/or exit from a room, comprising a revolving shaft with a number of door wings spaced evenly around it, a pair of panels at opposite ends bordering on the path followed by the door wings and forming a partly closed zone with a first and second opening, a drive motor for the shaft and a control unit for the drive motor, including a monitor unit with a detection aerial, which aerial generates a detection field, such that when a person carrying an authorization card enters the detection field the monitor unit sends an enable signal to the control unit to turn the shaft through a predetermined angle in the direction of passage to allow the person concerned to proceed from the one opening to the other, wherein each door wing comprises a detection aerial, means being provided for switching on and off each aerial in turn, such that when the revolving door is not rotating only the detection aerial of that particular door wing is activated, which, seen in the direction of passage, is in front of the person who wishes either to enter or leave the protected room.

2. Revolving door according to claim 1, wherein said means comprises a collector ring body mounted to the revolving shaft, which body is provided with a first collector ring with alternate conductive and non-conductive sectors, for each door wing being provided a conductive sector, to which the one end of the corresponding detection aerial is connected, which collector ring body comprises a second uninterrupted conductive collector ring to which the other ends of all detection aerials are connected, both collector rings being connected to the monitor unit by means of a corresponding stationary contact element.

3. Revolving door according to claim 2, wherein each conductive sector of the first collector ring extends through an angle of about 180°/number of door wings, and wherein each sector is connected to the monitor unit by means of said stationary contact element as soon as the corresponding door wing reaches approximately the front edge of the one panel during rotation of the revolving door.

4. Revolving door according to claim 1, 2 or 3, wherein said means for switching on and off each aerial is adapted to immediately switch off a switched-on aerial as soon as a person carrying an authorization card has been detected.

5. Revolving door according to claim 1, wherein each door wing comprises a metal frame and the metal frame of each door wing is used as a detection aerial.

* * * * *